United States Patent [19]

Thacker et al.

[11] Patent Number: 4,473,461

[45] Date of Patent: Sep. 25, 1984

[54] CENTRIFUGAL DRYING AND DEDUSTING PROCESS

[75] Inventors: Milton B. Thacker, Aurora; Paul B. Miller, Littleton, both of Colo.

[73] Assignee: Standard Oil Company (Indiana), Chicago, Ill.

[21] Appl. No.: 285,455

[22] Filed: Jul. 21, 1981

[51] Int. Cl.[3] ..... C10G 1/00; C10G 31/10

[52] U.S. Cl. ..... 208/11 R; 208/251 R; 208/177; 208/8 R; 210/806

[58] Field of Search ..... 208/251 R, 8 R, 177, 208/11 R; 210/806

[56] References Cited

U.S. PATENT DOCUMENTS

| | | | |
|---|---|---|---|
| 3,798,153 | 3/1974 | Arndt et al. | 208/251 R X |
| 3,923,643 | 12/1975 | Lewis et al. | 208/251 R |
| 4,040,958 | 8/1977 | Rammler | 210/806 X |
| 4,124,495 | 11/1978 | Bazell | 208/251 R |
| 4,199,432 | 4/1980 | Tamm et al. | 208/11 R X |

OTHER PUBLICATIONS

Congram, G. E., *Refiners Zero in on Better Desalting,* Oil and Gas Journal, pp. 153–154.

Waterman, L. C., *Crude Desalting: Why and How,* Hydrocarbon Processing and Petroleum Refiner, (Feb. 1965).

*Primary Examiner*—Delbert E. Gantz

*Assistant Examiner*—Glenn A. Caldarola

*Attorney, Agent, or Firm*—Thomas W. Tolpin; William T. McClain; William H. Magidson

[57] ABSTRACT

A centrifugal drying and dedusting process is provided to dedust heavy oil derived from solid hydrocarbon-containing material such as oil shale, coal or tar sand. In the process, heavy oil laden with particulates derived from the solid hydrocarbon-containing material is centrifuged into a dedusted stream of heavy oil and a dust laden centrifuge sludge. The dedusted stream of oil can be further dedusted in a desalter, after being first mixed with fresh water, to form a purified, highly dedusted, effluent stream of heavy oil. Dust laden water from the desalter is centrifuged into a dedusted stream of water and a dewatered centrifuge sludge. The dedusted stream of water is recycled upstream of the desalter and mixed with the influent oil stream. Desirably, the centrifuges sludges are mixed, heated, dried and separated into another dedusted stream of oil and a powdery, dust-enriched residual stream which can be combusted in a lift pipe for use as heat carrier material in the dryer and retort.

82 Claims, 5 Drawing Figures

CENTRIFUGAL DRYING AND DEDUSTING PROCESS

BACKGROUND OF THE INVENTION

This invention relates to synthetic fuels, and more particularly, to a process for dedusting heavy oil laden with dust derived from solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane, and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In principle, the retorting of shale and other hydrocarbon-containing materials, such as coal and tar sand, comprise heating the solid hydrocarbon-containing material to an elevated temperature and recovering the vapors and liberated effluent. However, as medium grade oil shale yields approximately 25 gallons of oil per ton of shale, the expense of materials handling is critical to the economic feasibility of a commercial operation.

In surface retorting, oil shale is mined from the ground, brought to the surface, crushed and placed in vessels where it is contacted with a hot heat transfer carrier, such as ceramic or metal balls, hot spent shale or sand for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the reactor and recycled as heat carrier material or discarded. The combustion gases are dedusted in a cyclone or electrostatic precipitator.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

During fluid bed, moving bed and other types of surface retorting, decrepitation of oil shale occurs creating a popcorning effect in which particles of oil shale collide with each other and impinge against the walls of the retort forming substantial quantities of minute entrained particulates of shale dust. The use of hot spent shale or sand as heat carrier material aggravates the dust problem. Rapid retorting is desirable to minimize thermal cracking of valuable condensable hydrocarbons, but increases the rate of decrepitation and amount of dust. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sand and gilsonite create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it is separated into fractions of light gases, light oils, middle oils and heavy oils with the bottom heavy oil fraction containing essentially all of the dust. As much as 50% by weight of the bottom heavy oil fraction consists of dust.

It is very desirable to upgrade the bottom heavy oil into more marketable products, such as light oils and middle oils, but because the heavy oil fraction is laden with dust, it is very viscous and cannot be pipelined. Dust laden heavy oil plugs up hydrotreaters and catalytic crackers, gums up valves, heat exchangers, outlet orifices, pumps and distillation towers, builds up insulative layers on heat exchange surfaces reducing their efficiency and fouls up other equipment. Furthermore, the dusty heavy oil corrodes turbine blades and creates emission problems. If used as a lubricant, dusty heavy oil is about as useful as sand. Moreover, the high nitrogen content in the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at very high temperatures and the product stream must be maintained at or above the highest temperature attained during the retorting process to prevent any condensation and accumulation of dust on processing equipment. Maintaining the effluent steam at high temperatures in not only expensive from an energy standpoint, but it allows detrimental side reactions, such as cracking, coking and polymerization of the effluent product stream, which tends to decrease the yield and quality of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 2,235,639; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,696,021; 3,703,442; 3,784,462; 3,799,855; 3,808,120; 3,900,389; 3,901,791; 3,929,625; 3,974,073; 3,990,885; 4,028,222; 4,040,958; 4,049,540; 4,057,490; 4,069,133; 4,080,285; 4,088,567; 4,105,536; 4,151,073; 4,159,949; 4,162,965; 4,166,441; 4,182,672; 4,199,432; 4,220,522; 4,226,690 and 4,246,093 as well as in the articles by Rammler, R. W., *The Retorting of Coal, Oil Shale, and Tar Sands by Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and Schmalfeld, I. P., *The Use of The Lurgi/Ruhrgas Process for the Distillation of Oil Shale,* Volume 70, Number 3, Quarterly of the Colorado School of Mines, pages 129–145 (July 1975).

Single and two stage desalters have been used for many years to desalt crude oil. Crude oil as it is received at the refinery averages about 0.25% basic sediment and water with salt contents from 3 ptb (pounds per thousand barrels of crude) to 200 ptb. As originally applied, desalting meant removal of about 90% of the chlorides of sodium, calcium and magnesium, collectively referred to as "brine," in the salty connate water which if not removed would produce hydrogen chloride and ultimately hydrochloric acid in refinery equipment at about 250° F. Although the term is still the same, desalting now broadly refers to eliminating a variety of contaminants in crude oil, including sulfates. Two stage desalting can remove as much as 99% of the salt in connate water. Desalting also removes from 50% to 75% of the inorganic sediment in crude oil, namely, fine particles of sand, clay, volcanic ash, drilling mud, rust, iron sulfide, metal and scale. Arsenic and iron contained in organic sediment in crude oil are also removed and decreased by the desalter to tolerable limits. Other trace metals in crude oil, such as vanadium, nickel, aluminum, barium and copper are removed to a much lesser extent.

Conventional desalting is described in Waterman, L. C., *Theories and Benefits of Desalting,* Tech. 64–37, National Petroleum Refiners Association (1964); Congram, G. E., *Refiners Zero In on Better Desalting,* Oil and Gas Journal, pages 153–154 (Dec. 30, 1974); Smith, R. S., *How to Calculate Rapidly for Two-Stage Desalting,* Oil and Gas Journal (Sept. 30, 1974); Frazier, A. W., *Optimized Two-Stage Desalting of Crude Oil,* M75–79, Research and Development Department, Amoco Oil Company (1975); and *Two-Stage Desalting of Crude Oil and Its Economic Justifications,* Petreco Division, Petrolite Corporation, containing Fisher, L. E., et al., *Crude Oil Desalting,* reprinted from Vol. 1, No. 5, Materials Protection pages 8–11 and 14–17 (May 1962), *Petreco Crude Oil Desalting* and Waterman, L. C., *Crude Desalting: Why and How,* Hydrocarbon Processing and Petroleum Refiner (February 1965).

Attempts have been made to dedust shale oil in a single stage desalter without the use of a centrifuge and dryer. These prior art processes and equipment have not been successful in decreasing the dust concentration in the heavy shale oil fraction to commercially acceptable levels.

It is therefore desirable to provide an improved process, which overcomes most, if not all, of the preceding problems.

SUMMARY OF THE INVENTION

An improved process is provided for dedusting heavy oil derived from solid hydrocarbon-containing material such as oil shale, coal or tar sand, into purified streams of oil. Advantageously, the dedusted oil can be safely pipelined through valves, outlet orifices, pumps, heat exchangers and distillation columns and can be refined in hydrotreaters and catalytic crackers.

The heavy oil can be derived from in situ retorting or surface retorting, such as in a screw conveyor retort or fluid bed retort where hot spent hydrocarbon-containing material is used as heat carrier material to retort raw oil shale, coal or tar sand, and in which the retorted effluent product stream is separated in a single or multiple stage separator, such as a quench tower, scrubber or distillation column, sometimes referred to as a "fractionating column" or "fractionator," into a bottom heavy oil fraction containing as much as 25% to 50% particulates of dust derived from the solid hydrocarbon-containing material.

In the novel process, dust laden heavy oil is fed to a centrifuge where it is separated into a first purified (dedusted) stream of heavy oil containing less than 0.3% to 1% by weight dust and a first dust laden residual stream or centrifuge sludge containing a higher concentration of dust than the influent dust laden heavy oil. The centrifuge sludge is fed to a dryer such as a screw conveyor dryer or fluid bed dryer, where it is mixed and contacted with solid heat carrier material such as hot spent hydrocarbon-containing material, sand or ceramic or metal spherical pebbles or balls, or a combination thereof, at a sufficient temperature to separate the centrifuge sludge into a second purified (dedusted) stream of oil containing less than 2% to 5% by weight dust and a powdery dust-enriched residual stream containing a higher concentration of dust than the centrifuge sludge.

The purified stream from the centrifuge can be fed to a desalter, after being mixed with fresh water, where the resulting emulsion is separated into an even more purified (dedusted) stream of heavy oil containing from 10 ppm (parts per million) to 1000 ppm and preferably less than 100 ppm dust. The desalter can be a chemical or electrical desalter and can be preceded by a large diameter pipe coalescer. The desalter lowers the dust content of the oil by stripping the oil from the dust, entraining the dust in water droplets and dropping the entrained dust as heavy clusters through the water layer to the bottom of the desalter. The desalter also removes significant amounts of arsenic and other trace metals from the heavy oil.

A mixing valve or emulsifier valve upstream of the desalter disperses the water in the oil into enormous quantities of minute droplets from 0.00005 to 0.0005 inches in diameter to greatly increase the water surface area about twenty-five fold to promote dedusting. An emulsifier, surfactant and/or wetting agent can be added to the influent oil to enhance dedusting. An alkali such as caustic or soda ash can also be added to the fresh water to facilitate dedusting. Heat exchangers can be used upstream and downstream of the desalter to control the viscosity and temperature of the influent and effluent oil.

In some circumstances, it may be desirable to bypass the first centrifuge and feed the dust laden heavy oil from the separator directly to the desalter after being emulsified with water.

Effluent dust laden water from the desalter, also referred to as "desalter sludge," is fed to another centrifuge where it is separated into a dedusted water stream and a dust laden dewatered stream or second centrifuge sludge. The dedusted water stream is recirculated back to the desalter.

The second centrifuge sludge is discharged into the dryer. A flushing agent, such as light oil derived from the solid hydrocarbon-containing material, can be injected into the centrifuges to wash the sludges out of the centrifuges and into the dryer. The sludges flushed with light oil are mixed with the hot heat carrier material in the dryer and are heated and separated in the dryer into a purified (dedusted) stream of oil and steam containing less than 2% to 5% by weight dust and a powdery dust-enriched residual stream containing a higher concentration of dust than the sludges from the centrifuges. The temperature of the dryer can be controlled to coke, thermal crack and upgrade the heavy oil into lighter hydrocarbons, mainly, light oil and middle oil.

The powdery dust-enriched residual stream from the dryer is fed to a lift pipe. Heavy oil and carbon residue in the powdery residual stream and carbon residue in the retorted material are combusted in the lift pipe leaving a hot spent stream for use as a solid heat carrier material in the dryer and retort.

The term "dust" as used in this application means particulates derived from solid hydrocarbon-containing material and ranging in size from less than 1 micron to 1000 microns. The particulates can include retorted and raw, unretorted hydrocarbon-containing material, as well as spent hydrocarbon-containing material or sand if the latter are used as solid heat carrier material during retorting. Dust derived from the retorting of oil shale consists primarily of calcium, magnesium oxides, carbonates, silicates and silicas. Dust derived from the retorting or extraction of tar sand consists primarily of silicates, silicas and carbonates. Dust derived from the retorting, carbonization or gasification of coal consists primarily of char and ash.

The term "spent" residual stream as used herein means a dusty residual stream from the dryer in which most, if not all, of the heavy oil and carbon residue contained therein has been removed by combustion.

The term "desalter" as used herein means an apparatus which is conventionally used for desalting petroleum (crude oil), but which is specifically used in this invention to dedust heavy oil derived from solid hydrocarbon-containing material.

As used throughout this application, the term "retorted" hydrocarbon-containing material or "retorted" shale refers to hydrocarbon-containing material or oil shale, respectively, which has been retorted to liberate hydrocarbons leaving an organic material containing carbon residue.

The term "spent" hydrocarbon-containing material or "spent" shale as used herein means retorted hydrocarbon-containing material or shale, respectively, from which all of the carbon residue has been removed by combustion.

The terms "normally liquid," "normally gaseous," "condensible," "condensed," or "noncondensible" are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENTS

Figure 1:
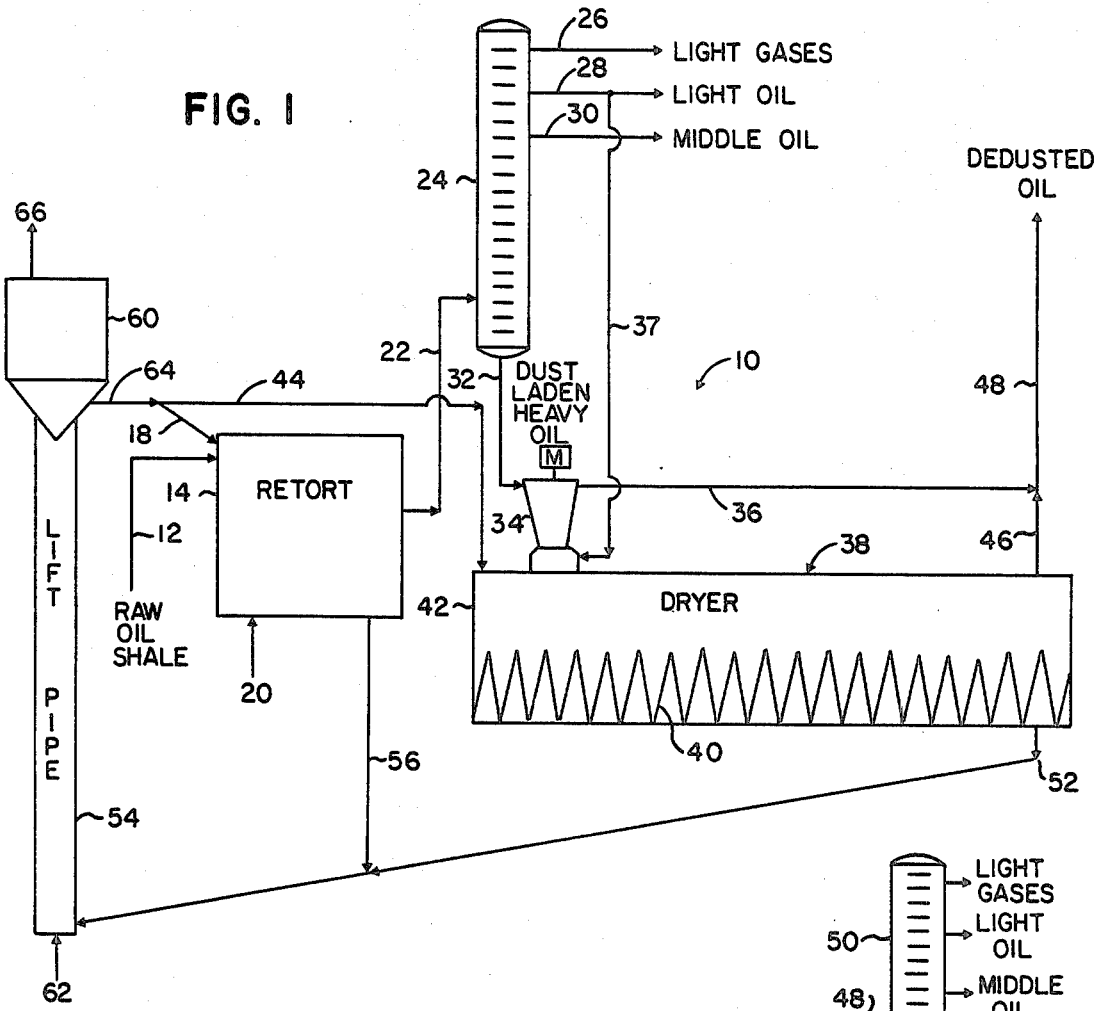
FIG. 1 is a schematic flow diagram of a process in accordance with principles of the present invention.

Refering now to FIG. 1, a centrifugal drying and thermal dedusting process and system 10 is provided to dedust dust laden heavy oil derived from solid hydrocarbon-containing material, such as oil shale, coal, tar sand, uintaite (gilsonite), lignite, and peat, into purified streams of heavy oil and lighter hydrocarbons for use in making synthetic fuels. While the process of the present invention is described hereinafter with particular reference to the processing of oil shale, it will be apparent that the process can also be used in connection with the processing of other hydrocarbon-containing materials, such as coal, tar sand, uintaite (gilsonite), lignite, peat, etc.

In process and system 10, raw fresh oil shale, which preferably contains an oil yield of at least 15 gallons per ton of shale particles, is crushed and sized to a maximum of fluidizable size of 10 mm and fed through raw shale inlet line 12 at a temperature from ambient temperature to 600° F. into a fluid bed retort 14, also referred to as a "fluidized bed retort." The fresh oil shale can be crushed by conventional crushing equipment, such as an impact crusher, jaw crusher, gyratory crusher or roll crusher, and screened with conventional screening equipment, such as a shaker screen or a vibrating screen.

Spent oil shale and a spent residual stream, which together provide a solid heat carrier material, are fed through heat carrier line 18 at a temperature of from 1000° F. to 1400° F., preferably from 1200° F. to 1300° F., into retort 14 to mix with heat and retort raw oil shale in retort 14. A fluidizing lift gas such as light hydrocarbon gases or other gases which do not contain an amount of molecular oxygen sufficient to support combustion, is injected into the bottom of retort 14 through a gas injector 20 to fluidize, entrain and enhance mixing of the raw oil shale and solid heat carrier material in retort 14. The retorting temperature of retort 14 is from 850° F. to 1000° F., preferably from 900° F. to 960° F. at atmospheric pressure.

During retorting, hydrocarbons are liberated from the raw oil shale as a gas, vapor, mist, or liquid droplets and most likely a mixture thereof, along with entrained particulates of oil shale dust ranging in size from less than 1 micron to 1000 microns.

The mixture of liberated hydrocarbons and entrained particulates are discharged from retort 14 through an outlet line 22 and conveyed to a separator 24, such as a quench tower or fractionating column. The effluent mixture can be partially dedusted in a cyclone (not shown) before being fed into separator 24. The effluent product stream of liberated hydrocarbons and entrained particulates are separated in quench tower or fractionating column 24 into fractions of light gases, light shale oil, middle shale oil, and heavy shale oil. Light gases, light shale oil, and middle shale oil are withdrawn from separator 24 through light gas line 26, light oil line 28 and middle oil line 30, respectively. Heavy shale oil has a boiling point over 600° F. to 800° F. Middle shale oil has a boiling point over 400° F. to 500° F., and light shale oil has a boiling point over 100° F.

The solids bottom heavy oil fraction is a slurry recovered at the bottom of separator 24 that contains from 15 percent to 35 percent by weight of the effluent product stream. The slurry, which is also referred to as "dust laden heavy oil" or "dusty oil," consists essentially of normally liquid heavy shale oil and from 1 percent to 50 percent by weight and preferably at least 25 percent by weight entrained particulates of oil shale dust. The temperature in separator 24 can be varied from 500° F. to 800° F. and preferably to a maximum temperature of 600° F. at atmospheric pressure to assure that essentially all the oil shale particulates gravitate to and are entrained in the bottom fraction.

The dust laden heavy oil is discharged from the bottom of separator 24 through heavy oil discharge line 32 and fed, preferably pumped, to a centrifuge at the discharge temperature of separator 24 and at a viscosity of less than 5 centistokes and preferably less than 2 centistokes.

The dusty oil is centrifuged in centrifuge 34 from 2000 rpm to 4000 rpm and preferably at 2500 rpm and at a pressure to minimize vaporization of the oil. Centrifuge 34 separates the dusty oil into a dedusted first purified stream and a first dust laden residual stream. The dedusted first purified stream consists of normally liquid heavy shale oil containing less than 1 percent, and preferably less than 0.3 percent, by weight shale dust. The dedusted heavy oil is a clear liquid or clarified heavy oil, also referred to as a "centrate," and is withdrawn from the upper portion of centrifuge 34 through centrate line 36.

The residual stream from centrifuge 34 consists of from 25 percent to 40 percent and preferably 30 percent by weight normally liquid heavy shale oil and from 60 percent to 75 percent and preferably 70 percent by weight shale dust. The residual stream or solid stream is a centrifugation sludge, cake, or residue, also referred to as a "first centrifuge sludge" or "sediment."

Light shale oil from separator 24 can be injected into centrifuge 34 through light oil injection line 37 to flush and wash out the sticky sludge from the bottom of centrifuge 34 into screw conveyor dryer or heater 38.

Dryer 38 has twin horizontal mixing screws 40 and an overhead vapor collection hood 42 which provides a dust settling and disentrainment space. Screws 40 operate in the range from 10 rpm to 100 rpm and preferably from 20 rpm to 30 rpm. Dryer 38 can also operate with a single screw. Spent oil shale and the spent residual stream, which together provide solid heat carrier material, are fed together through heat carrier line 44 into dryer 38 at a temperature from 800° F. to 1400° F. and preferably at about 1200° F. The solid heat carrier material provides the source of heat for dryer 38.

Screw conveyor dryer 38 mixes the centrifuge sludge from the first centrifuge 34 with heat carrier material at a heating temperature from 400° F. to 950° F., preferably from 700° F. to 900° F. and most preferably about 900° F. The solids flux feed rate ratio of the centrifuge sludge from the first centrifuge 34 to heat carrier material being fed to dryer 38 is from 2:1 to 7:1 and preferably from 3:1 to 5:1.

In dryer 38, the first centrifuge sludge flushed with light oil is heated, dried and separated into a dedusted second purified stream of normally liquid heavy shale oil and normally liquid light shale oil with less than five percent and preferably less than two percent by weight shale dust, leaving a powdery dust laden, second residual stream. The first centrifuge sludge, flushed with light oil, can be coked, thermal cracked and upgraded into lighter hydrocarbons, mainly, normally liquid light shale oil and normally liquid middle shale oil, in dryer 38.

The solids residence time in dryer 26 is from 0.5 minutes to 120 minutes and preferably from 10 minutes to 30 minutes. Dryer 38 operates at a pressure from a few inches water vacuum (−5 inches $H_2O$ or −0.18 psig) to 150 psig and preferably at atmospheric pressure.

Figure 2:
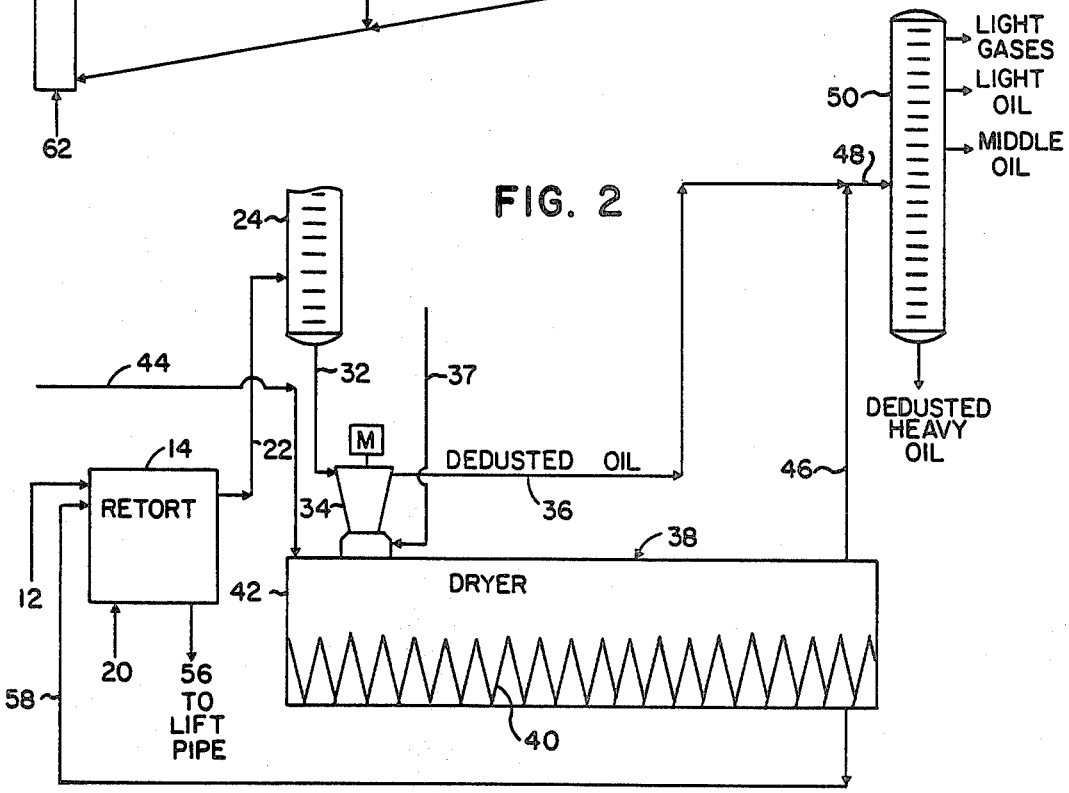
FIG. 2 is an alternative embodiment of part of the process of FIG. 1.

The second purified stream of oil is withdrawn from dryer 38 through overhead line 46 and mixed with the first purified stream of heavy oil in dedusted oil line 48 for upgrading and further processing. Alternatively, the purified streams can be fed to another quench tower or fractionating column 50 as shown in FIG. 2 before further upgrading and processing.

The powdery dust laden, second residual stream and the solid heat carrier material in dryer 38 are discharged together from the bottom of dryer 38 through residue line 52 (FIG. 1) where they are conveyed and fed to the bottom of a vertical lift pipe 54 by conveying means, such as a vibrating solid conveyor, pneumatic conveyor or screw conveyor.

Retorted shale and solid heat carrier material from retort 14 are discharged through the bottom of retort 14 into discharge line 56 where they are fed and mixed with the powdery second residual stream and heat carrier material from dryer 38. Alternatively, the powdery second residual stream and heat carrier material from dryer 38 can be fed into retort 14 via inlet line 58 as shown in FIG. 2 and subsequently discharged through the bottom of retort 14 along with the retorted shale and heat carrier material.

The powdery second residual stream, retorted shale and heat carrier material are fed together into the bottom portion of lift pipe 54 (FIG. 1) where they are fluidized, entrained, propelled and conveyed upwardly through the lift pipe into a collection and separation bin 60, also referred to as a "collector," by air injected into the bottom of lift pipe 54 through air injector nozzle 62.

Carbon residue in the retorted shale as well as heavy oil and carbon residue in the powdery second residual stream, are combusted in lift pipe 54 to heat the heat carrier material to a temperature from 1000° F. to 1400° F. and preferably from 1200° F. to 1300° F. The combusted retorted shale and combusted powdery, second residual stream form hot spent oil shale and a hot spent residual stream, respectively, for use as solid heat carrier material in dryer 38 and retort 16.

The spent material is discharged from the bottom of separation bin 60 through heat carrier line 64. Part of the heat carrier material and heat carrier line 64 is fed into retort 14 via heat carrier line 18 and part of the heat carrier material in heat carrier line 50 is fed to dryer 38 via heat carrier line 44.

Combustion gases are withdrawn from the top of separation bin 60 through combustion gas line 66 and dedusted in a cyclone or electrostatic precipitator for discharge into the atmosphere or further processing.

Figure 3:
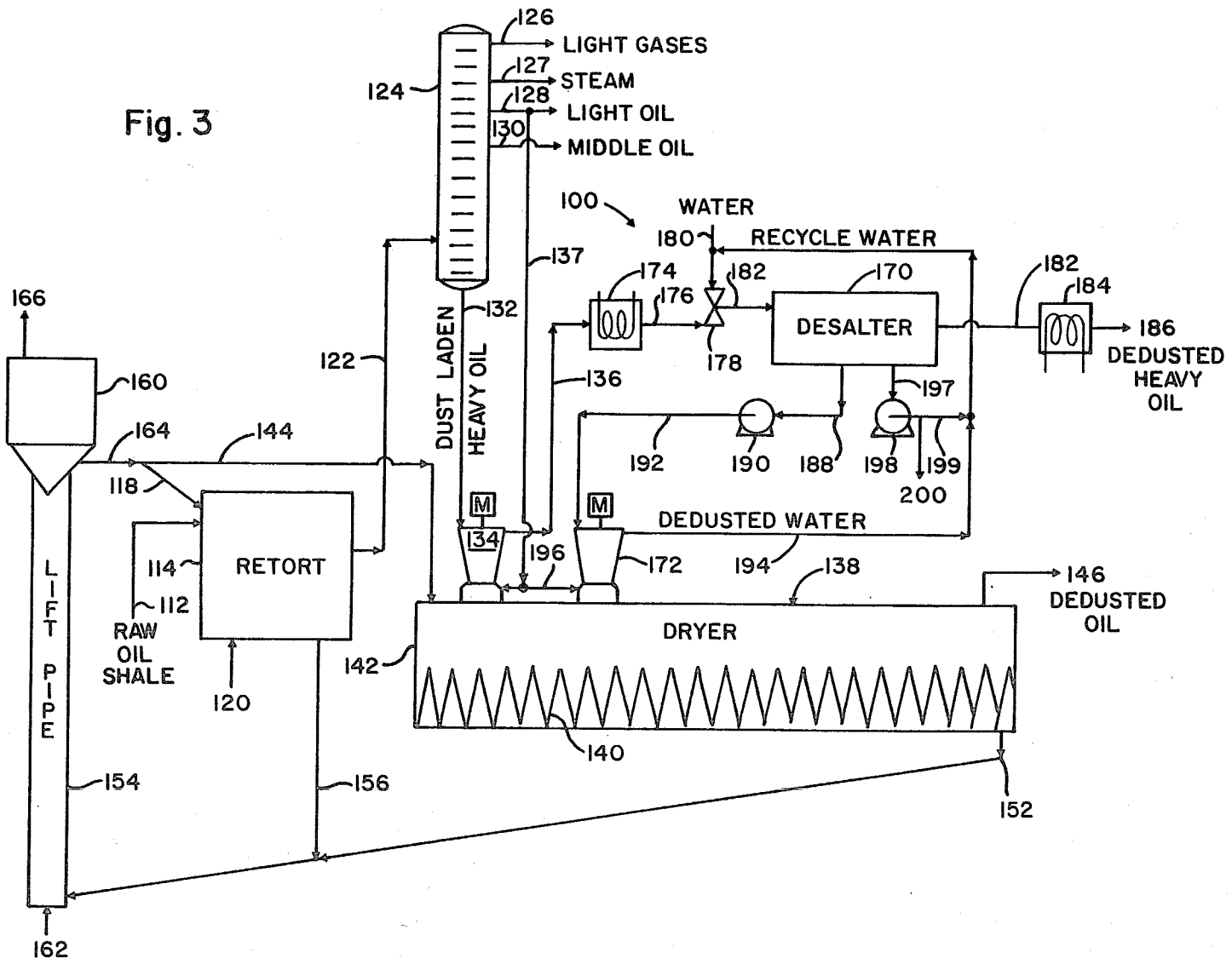
FIG. 3 is a schematic flow diagram of another process in accordance with principles of the present invention.

The centrifugal drying and thermal dedusting process and system 100 shown in FIG. 3 is similar to the centrifugal drying and thermal dedusting process in system 10 shown in FIG. 1, except that the purified stream of heavy shale oil from the first centrifuge 134 is further dedusted and purified in a desalter 170. Dust laden water from desalter 170 is centrifuged in a second centrifuge 172 into a purified water stream and a dewatered dust laden, powdery residual stream or second centrifuge sludge. The purified water stream is recycled to desalter 170. The second centrifuge sludge is mixed with the first centrifuge sludge in dryer 138. For ease of understanding and for clarity, similar parts and components of process and system 100 (FIG. 3) have been given part numbers similar to corresponding parts and components in process and system 10 (FIG. 1), except in the 100 series, such as retort 114, separator 124, etc.

In process and system 100 (FIG. 3), the purified stream of heavy shale oil from the first centrifuge 134 is fed through outlet line 136 to an influent heat exchanger or cooler 174 where the heavy oil is cooled to a temperature from 200° F. to 500° F. and preferably from 225° F. to 275° F. The cooled heavy oil flows through line 176 into a mixing valve or emulsifier valve 178 where the heavy oil is mixed with fresh water from water injection line 180 to form an emulsion. Fresh water can also be injected into the heavy oil before mixing valve 178.

The feed rate ratio by volume of water being mixed with the heavy oil is from 2 percent to 7 percent and preferably from 3 percent to 5 percent. An emulsifier, surfactant and/or wetting agent can also be injected into the heavy oil before water is added to lower surface tension and enhance dedusting.

Figures 4, 5:
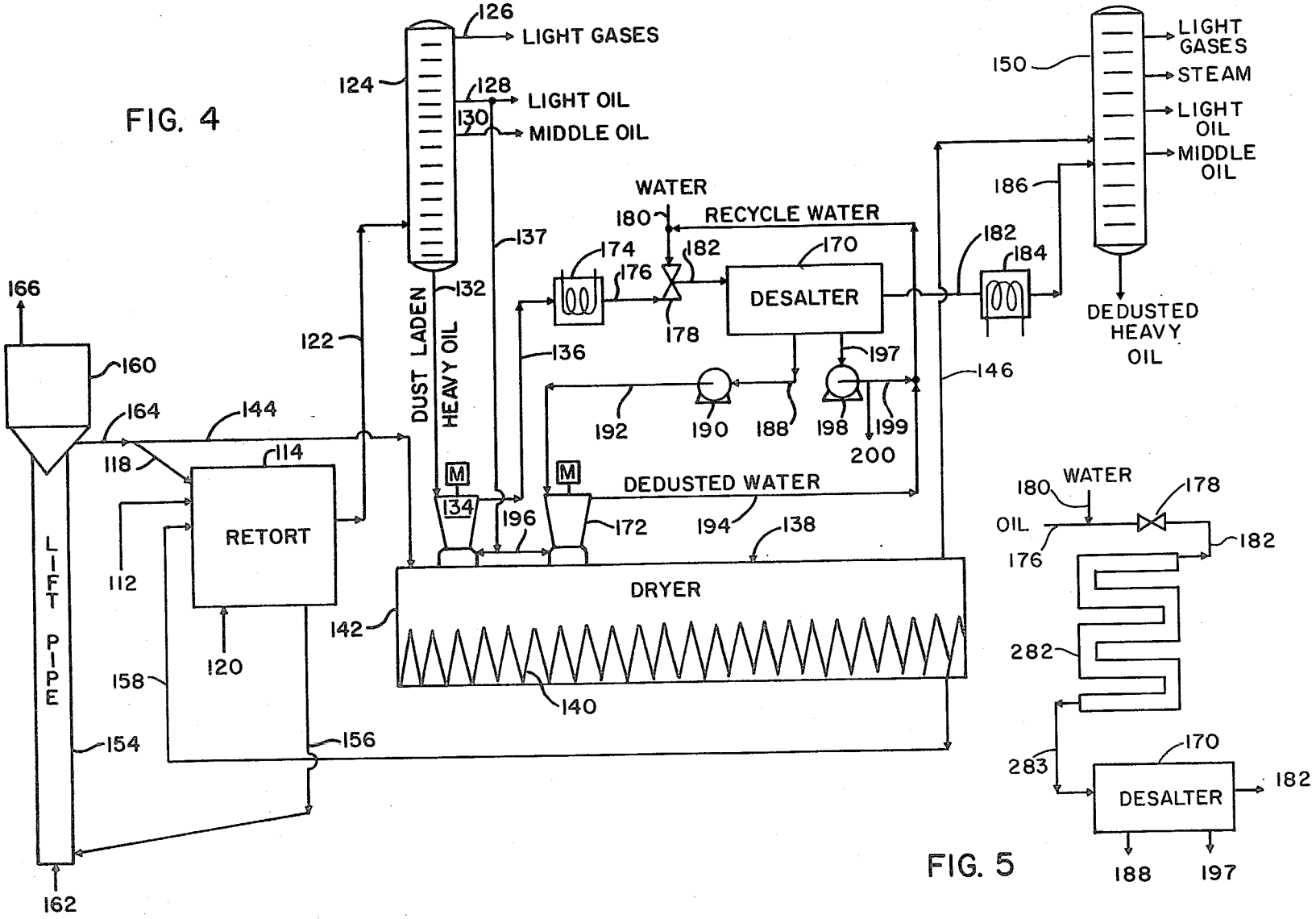
FIG. 4 is an alternative embodiment of the process of FIG. 3.
FIG. 5 is an alternative embodiment of part of the process of FIGS. 3 and 4.

The emulsion of heavy oil and water is fed through coalescer line 182 into desalter 170. In FIG. 5, an enlarged diameter pipe, zig-zag shaped coalescing section 282, and second coalescer line 283 is located immediately downstream of coalescer line 182 to further resolve the emulsion. The solids residence time in coalescer 282 is about 35 minutes.

Desalter 170 (FIG. 3) can be a chemical desalter or an electric desalter. The residence time in desalter 170 is from 0.5 minutes to 60 minutes and preferably from 10 minutes to 30 minutes. The pressure in desalter 170 is from atmospheric pressure to 140 psig and preferably at a pressure to minimize vaporization of the heavy oil.

Desalter 170 breaks up and separates the emulsion into a highly purified, dedusted stream of normally liquid heavy shale oil and a dust laden stream of water or desalter sludge. Advantageously, the effluent stream of heavy oil from the desalter contains only 10 ppm (0.001%) to 1000 ppm (0.1%) and preferably a maximum of 100 ppm (0.01%) by weight shale dust. Desalter 170 is also effective in removing significant amounts of arsenic and other trace metals from the heavy shale oil. The desalter sludge resolved from the emulsion in the desalter consists essentially of water with 20% to 60% and preferably 40% by weight shale dust as well as residual heavy shale oil, arsenic and other trace metals removed from the influent stream of heavy oil.

The effluent purified stream of heavy oil is withdrawn from desalter 170 through outlet line 182 and passed through an effluent heat exchanger or cooler 184 before being discharged through line 186 for upgrading and further processing. The heat transfer medium in heat exchangers 174 and 184 can be steam, light oil, middle oil or dedusted water from lines 127, 128, 130 or 194, respectively. Other hot heat transfer media can also be used.

Desalter sludge is pumped out of the bottom of desalter 170 through sludge line 188 by pump 190 to a second centrifuge 172 via access line 192. The sludge from the desalter is centrifuged in second centrifuge 172 at 2000 rpm to 4000 rpm and preferably at a maximum of 3000 rpm and at a pressure to minimize vaporization of the water. Second centrifuge 172 separates the desalter sludge into a purified, dedusted stream of water and a powdery dewatered, dust laden residual stream, also referred to as "second centrifuge sludge."

The effluent water from the second centrifuge 172 is a clear clarified water, also referred to as a water "centrate," with less than 0.5 percent and preferably less than 0.25 percent by weight shale dust. Dedusted water is withdrawn from the upper portion of second centrifuge 172 and recycled and injected into the fresh water line 180 through recirculation line 194. An alkali such as caustic or soda ash can be injected into the recirculated or fresh water stream, preferably at a maximum of five pounds of alkali per 1000 barrels of water, to facilitate emulsion separation and dedusting as well as to enhance removal of trace metals from the heavy oil.

An auxiliary water stream can be filtered and pumped from the bottom of desalter 170 through water effluent line 197 by pump 198 and injected into recirculation line 194 by injector line 199. Excess water can be removed through an outlet line 200 to balance the water in the system.

The second centrifuge sludge contains from 60 percent to 80 percent and preferably 70 percent by weight shale dust with the remainder being residual water, heavy oil residue, arsenic and trace metals. The second centrifuge sludge is a powdery cake, residue or sediment.

Light shale oil from separator 124 can be injected into second centrifuge 172 through light oil injection line 196 to flush and wash out the sticky sludge from the bottom of the second centrifuge into the screw conveyor dryer 138. In dryer 138, the second centrifuge sludge flushed with light oil is mixed with the first centrifuge sludge flushed with light oil from first centrifuge 134.

Dryer 138 operates in the same manner and in the same range as the dryer discussed above with respect to FIGS. 1 and 2 to separate the sludges from centrifuges 134 and 172 into a dedusted second purified stream and a powdery, dust enriched, solid residual stream. The dedusted second purified stream contains normally liquid heavy shale oil, normally liquid light shale oil and steam with less than five percent and preferably less than two percent by weight shale dust. The powdery, dust enriched residual stream has less than 20 percent and preferably less than 10 percent by weight shale oil and a higher concentration of shale dust than the centrifuge sludges from centrifuges 134 and 172. From 80 percent to 100 percent and preferably from 90 percent to 95 percent by weight of the heavy and light shale oil in the centrifuge sludges are separated and recovered in the effluent purified stream of oil from dryer 138. The centrifuge sludges may be coked, thermocracked and upgraded into lighter hydrocarbons, mainly, normally liquid light shale oil and normally liquid middle shale oil, in dryer 138.

The purified stream of oil from dryer 138 and the cooled effluent heavy oil from desalter 170 is discharged via lines 146 and 186, respectively, for upgrading and further processing, or alternatively, to another quench tower or fractionating column 150 as shown in FIG. 4 before further upgrading and processing. From 80 percent to 100 percent and preferably at least 90 percent to 95 percent by weight of the heavy shale oil in the bottom fraction of separator 124 is dedusted and recovered as purified streams of oil from desalter 170 and dryer 138.

The powdery, dust enriched residual stream from dryer 138 is conveyed to and combusted in vertical lift pipe 154 (FIG. 3) in the same manner as discussed above with respect to FIG. 1, or fed to retort 114 as shown in FIG. 4, to form a combusted, spent residual stream for use as heat carrier material in retort 114 and dryer 138.

Among the many advantages of the above processes are:

1. Improved product yield.
2. Better dedusting of the bottom heavy oil fraction.
3. Lower product viscosity.
4. Ability to pipeline the dedusted heavy shale oil through valves, outlet orifices, heat exchangers, pumps and distillation towers and refine the dedusted heavy shale oil in hydrotreaters and catalytic crackers.

While the retort shown in the preferred embodiments is a fluid bed retort, other retorts can be used such as a screw conveyor retort followed by a surge bin or rotating pyrolysis drum followed by an accumulator. Metal or ceramic balls can also be used as solid heat carrier material with the lift pipe serving as a ball heater. Sand can also be used as the heat carrier material. If desired, a fluid bed dryer can be used in lieu of a screw conveyor dryer. Furthermore, while it is preferred to heat the solid hydrocarbon-containing material with solid heat carrier material, it may be desirable in some circumstances to indirectly heat the solid hydrocarbon-containing material or heat the solid hydrocarbon-containing material with a gaseous heat carrier material.

Although embodiments of this invention have been shown and described, it is to be understood that various modifications and substitutions, as well as rearrangements and combinations of process steps, can be made by those skilled in the art without departing from the novel spirit and scope of this invention.

What is claimed is:

1. A process for producing and dedusting oil derived from solid hydrocarbon-containing material, comprising the steps of:

(a) retorting raw solid hydrocarbon-containing material selected from the group consisting of oil shale, tar sands, coal, lignite, peat and uintaite, by contacting said solid hydrocarbon-containing material in a surface retort with solid heat carrier material comprising a spent stream and a material selected from the group consisting of spent hydrocarbon-containing material, sand, ceramic balls and metal balls, at a sufficient temperature to liberate an effluent product stream of hydrocarbons and entrained particulates derived from said hydrocarbon-containing material;

(b) separating a fraction of particulate laden heavy oil from said effluent product stream in a separator;

(c) centrifuging said particulate laden heavy oil into a dedusted first stream of normally liquid heavy oil having a substantially lower concentration of particulates than said particulate laden heavy oil and a first residual stream having a higher concentration of particulates than said particulate laden heavy oil;

(d) feeding said first residual stream into a dryer;

(e) feeding said solid heat carrier material into said dryer;

(f) heating said first residual stream in said dryer by contacting said first residual stream with said solid heat carrier material to separate said first residual stream into a dedusted second stream of normally liquid heavy oil having a substantially lower concentration of particulates then said particulate laden heavy oil and a second residual stream containing normally liquid heavy oil and a higher concentration of particulates than said first residual stream; and (g) combusting said normally liquid heavy oil contained in said second residual stream in a lift pipe to leave a spent stream for use as part of said solid heat carrier material in steps (a), (e) and (f).

2. A process in accordance with claim 1 wherein said first residual stream is heated and fluidized in a fluid bed dryer.

3. A process in accordance with claim 1 wherein said first residual stream is heated in a screw conveyor dryer.

4. A process for dedusting particulate laden heavy oil derived from solid hydrocarbon-containing material, comprising the steps of:

centrifuging heavy oil laden with particulates derived from solid hydrocarbon-containing material into a dedusted first stream of normally liquid heavy oil having a substantially lower concentration of particulates than said particulate laden heavy oil and a first residual stream having a higher concentration of particulates than said particulate laden heavy oil;

feeding said first residual stream into a dryer;

heating said first residual stream in said dryer to separate said first residual stream into a dedusted second stream of normally liquid heavy oil having a substantially lower concentration of particulates than said particulate laden heavy oil and a second residual stream having a higher concentration of particulates than said first residual stream;

feeding said first stream of normally liquid heavy oil to a desalter;

separating said first stream of normally liquid heavy oil in said desalter into a dedusted third stream of heavy oil and a third residual stream, said dedusted third stream of heavy oil containing a substantially lower concentration of particulates than said first stream of heavy oil; and centrifuging said third residual stream in a second centrifuge into a purified stream of water and a fourth residual stream.

5. A process in accordance with claim 4 wherein said solid hydrocarbon-containing material is selected from the group consisting of oil shale, tar sand, coal, lignite, peat and uintaite.

6. A process in accordance with claim 4 wherein said fourth residual stream is fed to said dryer and separated into a dedusted fourth stream of heavy oil having a lower concentration of particulates than said particulate laden heavy oil and a fifth residual stream having a greater concentration of particulates than said fourth residual stream.

7. A process for dedusting particulate laden heavy oil derived from solid hydrocarbon-containing material, comprising the steps of:

centrifuging a particulate laden heavy oil fraction consisting essentially of normally liquid heavy oil having a boiling point over 600° F. and particulates of dust ranging in size from less than 1 micron to 1000 microns derived from solid hydrocarbon-containing material selected from the group consisting of oil shale, tar sand, coal, lignite, peat and uintaite into a dedusted first stream of normally liquid heavy oil containing a substantially lower concentration of said particulates than said fraction and a first residual stream containing a greater concentration of said particulates than said fraction;

feeding said first residual stream to a dryer;

heating said first residual stream in said dryer to separate said first residual stream into a dedusted second stream of normally liquid heavy oil containing a substantially lower concentration of particulates than said fraction and a second residual stream containing a greater concentration of particulates than the said first residual stream;

deriving said fraction from surface retorting of said solid hydrocarbon-containing material;

feeding said solid heat carrier material into said retort to heat said solid hydrocarbon-containing material;

feeding said solid heat carrier material into said dryer to heat said first residual stream;

combusting said second residual stream in a lift pipe; and feeding said combusted second residual stream to said retort and said dryer as at least part of said solid heat carrier material.

8. A process in accordance with claim 7 wherein said first residual stream is heated in a screw conveyor dryer.

9. A process in accordance with claim 7 wherein said first residual stream is heated and fluidized in a fluid bed dryer.

10. A process for dedusting particulate laden heavy oil derived from solid hydrocarbon-containing material, comprising the steps of:

centrifuging a particulate laden heavy oil fraction consisting essentially of normally liquid heavy oil having a boiling point over 600° F. and particulates of dust ranging in size from less than 1 micron to 1000 microns derived from solid hydrocarbon-containing material selected from the group consisting of oil shale, tar sand, coal, lignite, peat and uintaite into a dedusted first stream of normally liquid heavy oil containing a substantially lower concentration of said particulates than said fraction and a first residual stream containing a greater concentration of said particulates than said fraction;

feeding said first residual stream to a dryer;

heating said first residual stream in said dryer to separate said first residual stream into a dedusted second stream of normally liquid heavy oil containing a substantially lower concentration of particulates than said fraction and a second residual stream containing a greater concentration of particulates than the said first residual stream; and coking said first residual stream in said dryer.

11. A process for dedusting particulate laden heavy oil derived from solid hydrocarbon-containing material, comprising the steps of:

centrifuging a particulate laden heavy oil fraction consisting essentially of normally liquid heavy oil having a boiling point over 600° F. and particulates of dust ranging in size from less than 1 micron to 1000 microns derived from solid hydrocarbon-containing material selected from the group consisting of oil shale, tar sand, coal, lignite, peat and uintaite into a dedusted first stream of normally liquid heavy oil containing a substantially lower concentration of said particulates than said fraction and a first residual stream containing a greater concentration of said particulates than said fraction;

feeding said first residual stream to a dryer;

heating said first residual stream in said dryer to separate said first residual stream into a dedusted second stream of normally liquid heavy oil containing a substantially lower concentration of particulates than said fraction and a second residual stream containing a greater concentration of particulates than the said first residual stream; and thermal cracking said first residual stream in said dryer into a dedusted second stream of normally liquid heavy oil and lighter hydrocarbons containing less than 5% by weight particulates.

12. A process in accordance with claim 11 wherein said lighter hydrocarbons consist essentially of normally liquid middle oil and normally liquid light oil and said dedusted second stream contains less than 2% by weight particulates.

13. A process in accordance with claim 11 wherein said first residual stream is heated and fluidized in a fluid bed dryer.

14. A process in accordance with claim 11 wherein said first residual stream is heated in a screw conveyor dryer.

15. A process for dedusting particulate laden heavy oil derived from solid hydrocarbon-containing material, comprising the steps of:

centrifuging a particulate laden heavy oil fraction consisting essentially of normally liquid heavy oil having a boiling point over 600° F. and particulates of dust ranging in size from less than 1 micron to 1000 microns derived from solid hydrocarbon-containing material selected from the group consisting of oil shale, tar sand, coal, lignite, peat and uintaite into a dedusted first stream of normally liquid heavy oil containing a substantially lower concentration of said particulates than said fraction and a first residual stream containing a greater concentration of said particulates than said fraction;

feeding said first residual stream to a dryer;

heating said first residual stream in said dryer to separate said first residual stream into a dedusted second stream of normally liquid heavy oil containing a substantially lower concentration of particulates than said fraction and a second residual stream containing a greater concentration of particulates than the said first residual stream;

separating said first stream of heavy oil in a desalter into a dedusted third stream of heavy oil containing a substantially lower concentration of particulates than said first stream of heavy oil and a third residual stream;

centrifuging said third residual stream in a second centrifuge into a dewatered fourth residual stream; and separating said dewatered fourth residual stream in said dryer into a dedusted fourth stream of heavy oil admixed with said dedusted second stream and a fifth residual stream admixed with said second residual stream.

16. A process in accordance with claim 15 wherein said dewatered fourth residual stream is flushed from said second centrifuge.

17. A process in accordance with claim 16 wherein said flushing includes injecting light oil into said second centrifuge.

18. A process for dedusting shale oil, comprising:

(a) forming an emulsion by dispersing water in shale oil laden with shale dust;

(b) separating said emulsion in a desalter into a stream of shale oil having a substantially lower concentration of shale dust than said dust laden shale oil and desalter sludge having a substantially higher concentration of shale dust than said dust laden shale oil;

(c) centrifuging said desalter sludge into a stream of water and a centrifuge sludge having a substantially higher concentration of shale dust than said desalter sludge;

(d) feeding said centrifuge sludge to a dryer; and (e) heating said centrifuge sludge in said dryer at a sufficient temperature to separate said centrifuge sludge into a second stream of shale oil having a substantially lower concentration of shale dust than said dust laden shale oil and a dust laden residual stream having a substantially higher concentration of shale dust than said dust laden shale oil.

19. A process in accordance with claim 18 wherein said stream of water is recirculated upstream of said desalter for use in step (a).

20. A process in accordance with claim 18 wherein said centrifuge sludge is heated in said dryer by mixing said centrifuge sludge with solid heat carrier material in said dryer.

21. A process in accordance with claim 20 wherein said dust laden residual stream is combusted and fed to said dryer for use as said solid heat carrier material.

22. A process for dedusting shale oil, comprising the steps of:

(a) feeding a particulate laden heavy shale oil fraction consisting essentially of normally liquid heavy shale oil having a boiling point over 600° F. and from 25% to 50% by weight shale particulates ranging in size from 1 micron to 1000 microns, at a viscosity of less than 5 centistokes to a centrifuge;

(b) centrifuging said particulate laden heavy shale oil fraction in said centrifuge into a dedusted first stream consisting of said normally liquid heavy shale oil and less than 1% by weight of said shale particulates and a first residual stream consisting of from 25% to 40% by weight of said normally liquid heavy shale oil and from 60% to 75% by weight of said shale particulates;

(c) feeding said first residual stream to a screw conveyor dryer;

(d) feeding solid heat carrier material consisting essentially of spent oil shale and a spent stream into said screw conveyor dryer;

(e) heating said first residual stream in said screw conveyor dryer by mixing said first residual stream in said screw conveyor dryer with said solid heat carrier material at a sufficient heating temperature to separate said first residual stream into a dedusted second stream of hydrocarbons containing less than 5% by weight of said shale particulates and a second residual stream containing a maximum of 20% by weight of said normally liquid heavy shale oil and a higher concentration of said shale particulates than said first residual stream; and (f) combusting said normally liquid heavy shale oil contained in said second residual stream in a lift pipe to leave a spent stream for use as part of said solid heat carrier material in steps (d) and (e).

23. A process in accordance with claim 22 wherein said heating temperature of said screw conveyor dryer is from 400° F. to 950° F.

24. A process in accordance with claim 23 wherein said heating temperature of said screw conveyor dryer is from 700° F. to 900° F.

25. A process in accordance with claim 22 wherein said heating temperature of said screw conveyor dryer is about 900° F.

26. A process in accordance with claim 23 wherein said spent stream and spent oil shale are fed to said screw conveyor dryer at a temperature from 800° F. to 1400° F.

27. A process in accordance with claim 22 wherein said spent stream and spent oil shale are fed to said screw conveyor dryer at a temperature of about 1200° F.

28. A process in accordance with claim 22 wherein the solids residence time in said screw conveyor dryer is from 0.5 minutes to 120 minutes.

29. A process in accordance with claim 22 wherein the solids residence time in said screw conveyor dryer is from 10 minutes to 30 minutes.

30. A process in accordance with claim 22 wherein said first residual stream consists of 30% by weight of said normally liquid heavy shale oil and 70% by weight of said shale particulates.

31. A process in accordance with claim 22 wherein said second residual stream contains less than 10% by weight of said normally liquid heavy shale oil.

32. A process in accordance with claim 22 wherein said hydrocarbons in said dedusted second stream consist essentially of said normally liquid heavy shale oil.

33. A process in accordance with claim 22 wherein said first residual stream is coked and thermal cracked in said screw conveyor dryer and said hydrocarbons in said dedusted second stream consist essentially of normally liquid heavy shale oil, normally liquid middle shale oil and normally liquid light shale oil.

34. A process in accordance with claim 22 wherein said light shale oil fraction is injected into said centrifuge to flush said first residual stream out of said centrifuge.

35. A process in accordance with claim 22 wherein said dedusted second stream contains less than 2% by weight of said shale particulates.

36. A process in accordance with claim 22 wherein from 80% to 100% by weight of said normally liquid heavy shale oil in said particulate laden heavy oil fraction is dedusted and recovered in said dedusted first and second streams.

37. A process in accordance with claim 22 wherein from 90% to 95% by weight of said normally liquid heavy shale oil in said particulate laden heavy oil fraction is dedusted and recovered in said dedusted first and second streams.

38. A process in accordance with claim 22 wherein said dedusted first stream contains less than 0.3% by weight of said shale particulates.

39. A process for dedusting shale oil, comprising the steps of:

(a) feeding a particulate laden heavy oil fraction consisting essentially of normally liquid heavy shale oil having a boiling point over 600° F. and from 25% to 50% by weight particulates of shale dust ranging in size from 1 micron to 1000 microns, at a viscosity of less than 5 centistokes to a first centrifuge;

(b) centrifuging said particulate laden heavy shale oil fraction in said first centrifuge into a first purified stream of normally liquid heavy shale oil containing a substantially lower concentration of said shale dust than said particulate laden heavy shale oil fraction and a first residual stream containing a higher concentration of said shale dust than said particulate laden heavy shale oil fraction;

(c) withdrawing said first purified stream from said first centrifuge;

(d) mixing water with said first purified stream to form an emulsion;

(e) feeding said emulsion to a desalter;

(f) separating said emulsion in said desalter into a dedusted stream consisting of said normally liquid heavy shale oil and from 10 ppm to 1000 ppm shale dust and a particulate laden water stream;

(g) feeding said particulate laden water stream to a second centrifuge;

(h) centrifuging said particulate laden water stream in said second centrifuge into a purified water stream and a dewatered residual stream containing a higher concentration of said shale dust than said particulate laden water stream;

(i) feeding said first residual stream and said dewatered residual stream to a screw conveyor dryer;

(j) feeding solid heat carrier material containing a spent stream and spent oil shale to said screw conveyor dryer;

(k) heating said first residual stream and said dewatered residual stream in said screw conveyor by mixing said first residual stream and said dewatered residual stream in said screw conveyor dryer with said solid heat carrier material at a sufficient heating temperature to form a purified stream of hydrocarbons and steam containing less than 5% by weight of said shale dust and a dust-enriched residual stream containing a maximum of 20% by weight of said normally liquid heavy shale oil; and (l) combusting said normally liquid heavy shale oil contained in said dust-enriched residual stream in a lift pipe to leave a spent stream for use as part of said solid heat carrier material in steps (j) and (k).

40. A process in accordance with claim 39 in said first purified stream is fed to a cooler and cooled to a temperature of from 200° F. to 500° F. before water is mixed with said first purified stream.

41. A process in accordance with claim 39 wherein said first purified stream is cooled to a temperature from 225° F. to 275° F.

42. A process in accordance with claim 40 wherein light shale oil derived from said light shale oil fraction is circulated through said cooler.

43. A process in accordance with claim 39 wherein said dedusted stream is cooled in a cooler.

44. A process in accordance with claim 39 wherein said dedusted stream and said purified stream of hydrocarbons and steam are fed to a separator.

45. A process in accordance with claim 39 wherein said desalter includes a chemical desalter and an emulsifier is injected into said first purified stream before water is mixed with said first purified stream.

46. A process in accordance with claim 45 wherein said emulsion is fed through a coalescer before being fed to said desalter.

47. A process in accordance with claim 39 wherein said desalter includes an electrical desalter and a surfactant containing a wetting agent is injected into said first purified stream before water is mixed with said first purified stream.

48. A process in accordance with claim 39 wherein the residence time in said desalter is from 0.5 minutes to 60 minutes.

49. A process in accordance with claim 39 wherein the residence time in said desalter is from 10 minutes to 30 minutes.

50. A process in accordance with claim 39 wherein the feed rate ratio by volume of water being mixed with said first purified stream is from 2% to 7%.

51. A process in accordance with claim 39 wherein said feed rate ratio is from 3% to 5%.

52. A process in accordance with claim 39 wherein an alkali selected from the group consisting of caustic and soda ash is injected into said purified water stream.

53. A process in accordance with claim 39 wherein the pressure of said desalter is from atmospheric pressure to 140 psig.

54. A process in accordance with claim 39 wherein said particulate laden water stream from said desalter contains from 20% to 60% by weight of said shale dust.

55. A process in accordance with claim 39 wherein said purified water stream from said second centrifuge contains less than 0.5% by weight shale dust.

56. A process in accordance with claim 39 wherein said purified water stream from said second centrifuge contains, less than 0.25% by weight shale dust.

57. A process in accordance with claim 39 wherein said dust-enriched residual stream contains from 60% to 80% by weight of said shale dust.

58. A process in accordance with claim 39 wherein said heating temperature of said screw conveyor dryer is from 400° F. to 950° F.

59. A process in accordance with claim 39 wherein said heating temperature of said screw conveyor dryer is from 700° F. to 900° F.

60. A process in accordance with claim 59 wherein said spent stream and said spent oil shale are fed into said screw conveyor dryer at a temperature from 800° F. to 1400° F.

61. A process in accordance with claim 39 wherein light oil shale is injected into said second centrifuge to flush said dewatered residual stream out of said second centrifuge.

62. A process in accordance with claim 61 wherein said light shale oil is injected into said first centrifuge to flush said first residual stream out of said first centrifuge.

63. A process in accordance with claim 62 wherein said hydrocarbons in said purified stream in said screw conveyor dryer consist essentially of normally liquid heavy shale oil and normally liquid light shale oil.

64. A process in accordance with claim 39 wherein said first residual stream and said dewatered residual stream are thermal cracked and coked in said screw conveyor dryer and said hydrocarbons in said purified stream in said screw conveyor dryer consist essentially of normally liquid heavy shale oil, normally liquid middle shale oil and normally liquid light shale oil.

65. A process in accordance with claim 39 wherein said purified stream from said screw conveyor dryer contains less than 2% by weight shale dust.

66. A process in accordance with claim 39 wherein said dedusted stream of heavy shale oil from said desalter contains a maximum of 100 ppm of said shale dust.

67. A process in accordance with claim 39 wherein from 80% to 100% by weight of said normally liquid heavy shale oil in said particulate laden heavy oil fraction is dedusted and recovered in said dedusted stream from said desalter and said purified stream from said screw conveyor dryer.

68. A process in accordance with claim 67 wherein at least 90% by weight of said normally liquid heavy shale oil is dedusted and recovered.

69. A process for producing and dedusting shale oil, comprising the steps of:

(a) introducing raw oil shale into a retort from ambient temperature to 600° F;

(b) introducing solid heat carrier material consisting essentially of a spent stream and spent oil shale into said retort at a temperature from 1000° F. to 1400° F;

(c) mixing said raw oil shale with said solid heat carrier material in said retort at a retorting temperature of 850° F. to 1000° F. to liberate a mixture of hydrocarbons and entrained shale particulates ranging in size from less than 1 micron to 1000 microns;

(d) separating a light shale oil fraction and a 15% to 35% by weight particulate laden heavy shale oil fraction from said mixture in a separator, said particulate laden heavy shale oil fraction consisting essentially of normally liquid heavy shale oil having a boiling point over 600° F. and from 25% to 50% by weight of said shale particulates;

(e) feeding said particulate laden heavy shale oil fraction at a viscosity of less than 5 centistokes to a centrifuge;

(f) centrifuging said particulate laden heavy shale oil fraction in said centrifuge into a dedusted first stream consisting of said normally liquid heavy shale oil and less than 1% by wei9ht of said shale particulates and a first residual stream consisting of from 25% to 40% by weight of said normally liquid heavy shale oil and from 60% to 75% by weight of said shale particulates;

(g) feeding said first residual stream to a screw conveyor dryer;

(h) feeding said solid heat carrier material to said screw conveyor dryer at a temperature from 800° F. to 1400° F;

(i) heating said first residual stream in said screw conveyor dryer by mixing said first residual stream in said screw conveyor dryer with said solid heat carrier material at a heating temperature of 400° F. to 950° F. to separate said first residual stream into a dedusted second stream of hydrocarbons containing less than 5% by weight of said shale particulates and a second residual stream containing a maximum of 20% by weight of said normally liquid heavy shale oil and a higher concentration of said shale particulates than said first residual stream; and (j) combusting said normally liquid heavy shale oil contained in said second residual stream in a lift pipe to leave a spent stream for use as part of said solid heat carrier material.

70. A process in accordance with claim 69 wherein retorted shale is conveyed from said retort to said lift pipe and carbon residue contained in said retorted shale is combusted in said lift pipe during step (j) to form spent oil shale for use as part of said solid heat carrier material.

71. A process in accordance with claim 69 wherein the heating temperature of said dryer is from 700° F. to 900° F.

72. A process in accordance with claim 71 wherein said solid heat carrier material is fed to said dryer at a temperature of about 1200° F.

73. A process in accordance with claim 69 wherein the temperature in said separator during step (d) is from 500° F. to 800° F. at about atmospheric pressure.

74. A process in accordance with claim 73 wherein the maximum temperature of said separator is 600° F.

75. A process in accordance with claim 69 wherein solid heat carrier material is fed to said retort at a temperature from 1200° F. to 1300° F.

76. A process in accordance with claim 75 wherein said retorting temperature is from 900° F. to 960° F.

77. A process for producing and dedusting shale oil, comprising the steps of:

(a) introducing raw oil shale into a retort from ambient temperature to 600° F.;

(b) introducing solid heat carrier material containing a spent stream and spent oil shale into said retort at a temperature from 1000° F. to 1400° F.;

(c) mixing said raw oil shale, with said solid heat carrier material in said retort at a retorting temperature of 850° F. to 1000° F. to liberate a mixture of hydrocarbons and entrained particulates of shale dust ranging in size from less than 1 micron to 1000 microns;

(d) separating a light shale oil fraction and a 15% to 35% by weight, particulate laden heavy shale oil fraction from said mixture in a separator, said particulate laden heavy shale oil fraction consisting essentially of normally liquid heavy shale oil having a boiling point over 600° F. and from 25% to 50% by weight of said shale dust;

(e) feeding said particulate laden heavy shale oil fraction at a viscosity of less than 5 centistokes to a first centrifuge;

(f) centrifuging said particulate laden heavy shale oil fraction in said first centrifuge into a first purified stream of normally liquid heavy shale oil containing a substantially lower concentration of said shale dust than said particulate laden heavy shale oil fraction and a first residual stream containing a higher concentration of said shale dust than said particulate laden heavy shale oil fraction;

(g) withdrawing said first purified stream from said first centrifuge;

(h) mixing water with said first purified stream to form an emulsion, (i) feeding said emulsion to a desalter;

(j) separating said emulsion in said desalter into a dedusted stream consisting of said normally liquid heavy shale oil and from 10 ppm to 1000 ppm by weight shale dust and a particulate laden water stream;

(k) feeding said particulate laden water stream to a second centrifuge;

(l) centrifuging said particulate laden water stream in said second centrifuge into a purified water stream and a dewatered residual stream containing a higher concentration of said shale dust than said particulate laden water stream;

(m) recycling said purified water stream for use in step (h);

(n) feeding said first residual stream and said dewatered residual stream to a screw conveyor dryer;

(o) feeding said solid heat carrier material to said screw conveyor dryer at a temperature from 800° F. to 1400° F.;

(p) heating said first residual stream and said dewatered residual stream in said screw conveyor by mixing said first residual stream and said dewatered residual stream in said screw conveyor dryer with said solid heat carrier material at a heating temperature of 400° F. to 950° F. to form a purified stream of hydrocarbons and steam containing less than 5% by weight of said shale dust and a dust-enriched residual stream containing a maximum of 20% by weight of said normally liquid heavy shale oil; and (q) combusting said normally liquid heavy shale oil contained in said dust-enriched residual stream in a lift pipe to leave a spent stream for use as part of said solid heat carrier material.

78. A process in accordance with claim 76 wherein said dedusted stream contains a maximum of 100 ppm by weight shale dust.

79. A process in accordance with claim 76 wherein the residence time of said emulsion in said desalter is from 0.5 minutes to 60 minutes at a pressure to minimize vaporization of said heavy shale oil.

80. A process in accordance with claim 79 wherein the residence time of said emulsion in said desalter is from 10 minutes to 30 minutes.

81. A process in accordance with claim 76 wherein the heating temperature of said dryer is from 700° F. to 900° F.

82. A process in accordance with claim 76 wherein said heat carrier material is fed to said retort at a temperature from 1200° F. to 1300° F., said retorting temperature is from 900° F. to 960° F. and the temperature in said separator is from 500° F. to 800° F.

* * * * *

UNITED STATES PATENT AND TRADEMARK OFFICE

CERTIFICATE OF CORRECTION

PATENT NO. : 4,473,461

DATED : September 25, 1984

INVENTOR(S) : Milton B. Thacker et al.

It is certified that error appears in the above-identified patent and that said Letters Patent is hereby corrected as shown below:

Column 3, line 11, "steam" should read -- stream --.

Column 3, line 11, "in" should read -- is --.

Column 18, line 7, "in", second occurrence, should read -- wherein --.

Column 18, line 59, delete ",".

Column 19, line 66, "weight" should read -- weight --.

Signed and Sealed this

*Fifth* Day of *August 1986*

[SEAL]

*Attest:*

DONALD J. QUIGG

*Attesting Officer*

*Commissioner of Patents and Trademarks*